United States Patent [19]

Surovikin et al.

[11] Patent Number: 4,464,314

[45] Date of Patent: Aug. 7, 1984

[54] AERODYNAMIC APPARATUS FOR MIXING COMPONENTS OF A FUEL MIXTURE

[76] Inventors: Vitaly F. Surovikin, ulitsa Lermontova, 20, kv. 80; Vladimir F. Antonenko, Kamerny pereulok, 46, kv. 61; Gennady V. Babich, ulitsa 20 let RKKA, 40, kv. 15; Mikhail Y. Bobrik, ulitsa Chekhova, 3, kv. 102; Nikolai K. Korenyak, Kamerny pereulok, 52, kv. 39; Vasily V. Novikov, ulitsa 22 aprelya, 14a, kv. 36; Gennady A. Voloshin, ulitsa Magistralnaya, 7, kv. 6; Georgy A. Belyaev, 3 Molodezhnaya, 56, kv. 24, all of Omsk; Alexandr V. Gordeev, prospekt Kanatchikov, 58, kv. 12; Nail I. Gallyamov, prospekt Kanatchikov, 30, kv. 12, both of Volgograd; Anatoly F. Krikunenko, 48, zavod tekhnicheskogo ugleroda, obschezhitie, Syzran, all of U.S.S.R.

[21] Appl. No.: 109,168

[22] Filed: Jan. 2, 1980

[51] Int. Cl.[3] ..... B01F 3/04

[52] U.S. Cl. ..... 261/79 A; 239/400; 239/404

[58] Field of Search ..... 261/79 A; 239/400, 404

[56] References Cited

U.S. PATENT DOCUMENTS

| | | | |
|---|---|---|---|
| 3,172,735 | 3/1965 | Barclay et al. | 239/404 |
| 3,662,960 | 5/1972 | Mitchell et al. | 239/400 |
| 3,811,278 | 5/1974 | Taylor et al. | 261/79 A |
| 3,946,552 | 3/1976 | Weinstein | 239/404 |
| 4,205,786 | 6/1980 | Babich et al. | 239/404 |

FOREIGN PATENT DOCUMENTS

| | | | |
|---|---|---|---|
| 1014789 | 8/1957 | Fed. Rep. of Germany | 261/79 A |
| 1156341 | 12/1957 | France | 239/404 |
| 2109683 | 5/1972 | France . | |
| 147707 | 3/1959 | Hungary . | |
| 1099959 | 1/1968 | United Kingdom | 239/400 |
| 1282070 | 7/1972 | United Kingdom . | |

OTHER PUBLICATIONS

Shurkin, Gas Burner Device with an Acoustic Generator, Gazovaya Promyshlennost, 1967, vol. 11, pp. 42–46.

*Primary Examiner*—Tim R. Miles

*Attorney, Agent, or Firm*—McAulay, Fields, Fisher Goldstein & Nissen

[57] ABSTRACT

An aerodynamic apparatus for mixing components of a fuel mixture comprises two cylindrical chambers—a main chamber and an auxiliary chamber—for swirling the flow of a gaseous component of a fuel mixture which is fed through at least one admission pipe arranged tangentially to the cylindrical surface of the chamber. The outlet pipes for the components are arranged in end walls coaxially with the chambers, and the end of the pipe of the auxiliary chamber is within the main chamber. The ratio of the inside diameters $d_1/d_2$ of the outlet pipes for components ranges from 1 to 3.

2 Claims, 3 Drawing Figures

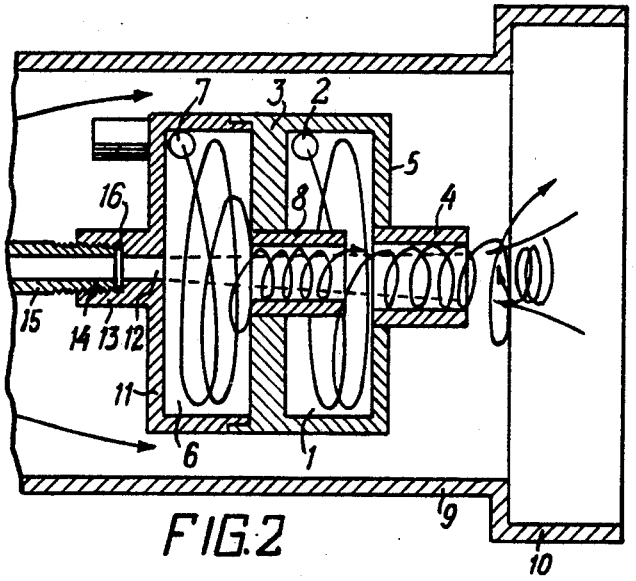
FIG.2
FIG.3
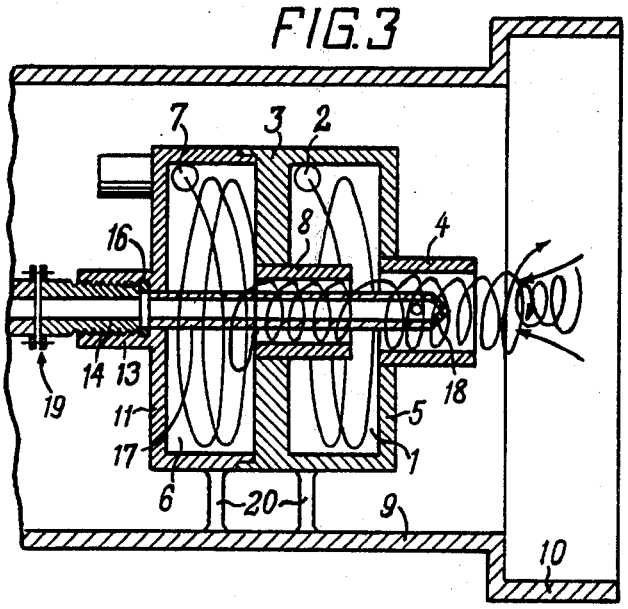

AERODYNAMIC APPARATUS FOR MIXING COMPONENTS OF A FUEL MIXTURE

FIELD OF THE ART

The invention relates to apparatus for forming mixtures, spraying and dispersing substances and, more particularly, to an aerodynamic apparatus for mixing components of a fuel mixture.

The apparatus may be used preferably in combustion plants as a burner or nozzle, in the chemical industry as reactant dispergator and also as a sprayer of feedstock and fuel in the production of technical carbon.

BACKGROUND OF THE INVENTION

At present the main parameters of production processes, such as completeness of combustion and fuel spray temperature in burning fuel, yield and propeties of end products in the chemical industry depend on quality of mixture formation and atomization of components of a fuel mixture.

The advent of more viscous grades of liquid fuel, sludges of petroleum refineries and strongly ballasted types of natural gases and off-gases in the practice of combustion requires continuous improvement of apparatus for mixture formation and preparation of fuel and air mixtures. Provision of a short luminous spray with boundaries appreciably spaced from refractory walls of combustion chambers enables an improvement of reliability and prolongation of service life of combustion plants. Improvement of completeness of gas combustion enables an improved yield of carbon black in the production of carbon black. Provision of a pre-set angle of spray of a feedstock in high-velocity flows up to 600 m/s enables an improvement of reinforcing properties of carbon black which is an active filler of rubber to be used in the manufacture of tyres and industrial rubber products. Moreover, aerodynamics of flame and its hydrodynamic structure depend to a large degree on characteristics of apparatus for mixing and atomization of a fuel and air mixture which depending on characteristics of combustion devices, affect the process of formation of nitrogen oxides, carbon monoxide and unburnt hydrocarbons.

Known in the art is an aerodynamic apparatus for mixing components of a fuel mixture, comprising a cylindrical chamber for swirling a flow of a gaseous component of a fuel mixture which is fed through at least one pipe for admission of a gaseous component arranged in direct proximity to an end wall of the cylindrical chamber tangentially to the cylindrical surface and which is let out through a cylindrical outlet pipe for the component arranged in the other end wall coaxially with the chamber (cf. E. N. Shurkin, Gas Burner Device with an Acoustic Generator (in Russian), Jr. Gazovaya promyshlennost, No. 11, 1967, pp. 42–46).

A flow of gaseous hydrocarbons is fed to the chamber. The flow is swirled and moves in the radial direction towards the central part of the chamber and also along a helical path towards the outlet pipe. The flow of hydrocarbons which continues its rotary and linear motion in the outlet pipe flows out of an outlet opening into the surrounding space where it is mixed with a concentrical air flow fed in the form of a linear or slightly swirled jet. The air jet is fed along a pipeline provided with an aerodynamic device. During the outflow of the vertical flow of hydrocarbons the air induces a reverse flow rotating in the same direction but moving linearly in the opposite direction. Interaction of the two flows generates acoustic oscillations which are used for mixing the air with the flow of hydrocarbons and with combustion products.

The efficiency of atomization and stirring of the flow of hydrocarbons is, however, low. The cost of swirling of the hydrocarbon flow is, at the same time, high. The use of only tangential admission of the flow of hydrocarbons into the chamber and the axial outlet strongly influence the flame stability during the process of combustion of an air and hydrocarbon mixture.

SUMMARY OF THE INVENTION

It is an object of the invention to provide an aerodynamic apparatus for mixing components of a fuel mixture which enables an improvement of the efficiency of mixing of components of a fuel mixture.

Another object of the invention is to improve the output without changing the cost of swirling of a fuel mixture.

Still another object of the invention is to improve the stability of flame of burning fuel and air mixture.

The above objects are accomplished by that in an aerodynamic apparatus for mixing components of a fuel mixture comprising a cylindrical chamber for swirling a flow of a gaseous component of a fuel mix which is fed through at least one pipe for admission of a gaseous component arranged in direct proximity to the end wall of the cylindrical chamber tangentially to the cylindrical surface, and let out through a cylindrical outlet pipe for the component arranged in the other end wall coaxially with the chamber, according to the invention, there is provided an auxiliary cylindrical chamber for swirling the flow of a gaseous component of a fuel mixture arranged coaxially with the main chamber having at least one pipe for feeding a gaseous component arranged in the cylindrical wall tangentially to the cylindrical surface and an outlet pipe for the component arranged coaxially with the auxiliary chamber in an opening made in the end wall of the main cylindrical chamber so that its butt-end is positioned in the main cylindrical chamber and the ratio of the inside diameters $d_1/d_2$ of the outlet pipes of the main and auxiliary chambers ranges from 1 to 3.

The outlet and auxiliary chamber outlet pipes are preferably of equal length.

The end wall of the auxiliary cylindrical chamber is preferably made with an axial opening for admission of a liquid or solid component.

The apparatus preferably comprises a pipe with a perforated nozzle for admission of a liquid or solid component, which is arranged in the opening of the end wall of the auxiliary chamber coaxially therewith, the end of the pipe being spaced at a distance of $(0.1–3)d_1$ from the end of the outlet pipe of the main chamber.

The provision of the auxiliary cylindrical chamber enables an improvement of the fuel atomization efficiency. The provision of two series-arranged chambers reduces hydraulic resistance of the outlet pipe of the main chamber, thereby reducing energy consumption for swirling the flow of hydrocarbons without changing the power of generated acoustic oscillations, and improving the stability of flame of burning fuel and air mixture. The provision of the auxiliary chamber enables the damping of precession of the central vortical return flow formed during the burning process thus allowing operation without vibrations of hydrocarbon admission pipelines. The ratio of inside diameters of the outlet pipes of the main and auxiliary chambers ranging from 1 to 3 enables an optimization of the process of mixing components of gaseous hydrocarbons thus improving the completeness of combustion of a fuel and air mixture.

The provision of the opening in the end wall of the auxiliary chamber improves the efficiency of atomization and mixing of drops of liquid hydrocarbons or solid particles of hydrocarbons with air flows rotating at different angular velocities thus reducing the drops more intensely. The arrangement of the end of the pipe having the perforated nozzle at a distance of $(0.1-3)d_1$ from the end of the outlet pipe of the main chamber enables the use of viscous grades of hydrocarbons without coking of fuel on the inner surface of the outlet pipes. The time of contact of liquid drops with flows of air is prolonged, that is evaporation and mixing of the fuel mixture is improved.

BRIEF DESCRIPTION OF DRAWINGS

The invention will now be described with reference to specific embodiments illustrated in the accompanying drawings, in which:

FIG. 2 is a longitudinal section of the apparatus shown in FIG. 1 having an opening in the end wall for admission of a liquid or solid component, according to the invention;

FIG. 3 is a longitudinal section of the apparatus shown in FIG. 2 having a pipe for admission of a liquid or solid component arranged in the opening of the end wall, according to the invention.

DETAILED DESCRIPTION OF THE INVENTION

Figure 1:
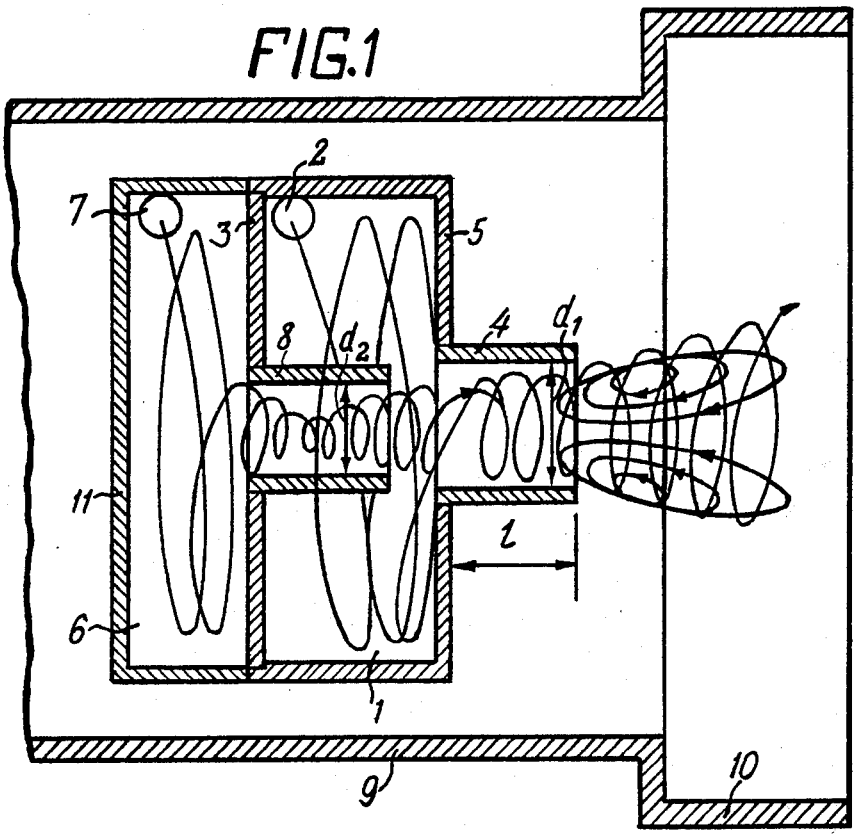
FIG. 1 is a longitudinal section of an aerodynamic apparatus for mixing components of a fuel mixture according to the invention.

An aerodynamic apparatus for mixing components of a fuel mixture comprises a cylindrical chamber 1 (FIG. 1) for swirling a flow of a gaseous component of a fuel mixture. A flow of a gaseous component is admitted through one pipe 2 arranged in direct proximity to an end wall 3 of the cylindrical chamber 1 tangentially to the cylindrical surface. Gas flow is removed from the chamber 1 through an outlet cylindrical pipe 4 arranged in the other end wall 5 coaxially with the chamber 1.

The apparatus also comprises an auxiliary cylindrical chamber 6 for swirling the flow of a gaseous component of a fuel mixture which is also arranged coaxially with the main chamber. A pipe 7 for admission of a gaseous component is arranged in the cylindrical wall of the chamber 6 tangentially to the cylindrical surface. The outlet pipe 8 of the auxiliary chamber 6 is arranged in an opening of the end wall 3 of the main chamber 1 in such a manner that its end is within the main cylindrical chamber 1. The chambers 1 and 6 have a common wall 3 in this embodiment. The ratio of the inside diameters $d_1/d_2$ of the outlet pipes 4 and 8 ranges from 1 to 3. This enables the reduction of hydraulic resistance of the pipe 4 and improves stability of flame during combustion.

The chamber 6 is welded over its end face to the chamber 1 to form a solid structure. The apparatus is placed in a pipeline 9 supplying air to a combustion chamber 10, directly adjacent to its inlet.

The pipes 4 and 8 of the main and auxiliary chamber 1 and 6, respectively, are of equal length.

For admission of a liquid or solid component, an end wall 11 (FIG. 2) of the auxiliary cylindrical chamber 6 has an opening 12. The wall 11 of the chamber 6 has protrusions 13 with threaded portions 14 for coupling a pipeline 15 for admission of a liquid component, which is sealed by means of a gasket 16.

In another embodiment the opening 12 (FIG. 3) may accommodate a pipe 17 having a perforated nozzle 18 for feeding a liquid or solid component. The end of the pipe 17 is spaced at a distance of (0.1–3) of the inside diameter $d_1$ of the pipe 4 from the end face thereof. The pipe 17 is fixed in the opening 12 by means of the threaded portion 14 and is connected to a fuel supply pipeline by means of a flange joint 19.

The aerodynamic apparatus for mixing components of a fuel mixture is secured in the air supply pipeline 9 to the combustion chamber 10 by means of supports 20 by welding.

The aerodynamic apparatus functions in the following manner.

The main flow of hydrocarbons is fed through the pipe 2 (FIG. 1) to the chamber 1 tangentially to the cylindrical surface at a pressure above 2.5 atm. which is greater than the critical pressure. The flow of a hydrocarbon mixture which moves in the radial direction increases the angular momentum before it reaches the outlet end of the pipe 4. Owing to a pressure difference along the pipe 4 and to the division of the total momentum at the outlet edge of the pipe 4, the flow of hydrocarbon mixture which moves linearly and rotates at a substantially constant angular velocity flows out into the combustion chamber 10. The flow of hydrocarbons is mixed in the combustion chamber 10 with a flow of air admitted through the pipeline 9, which may be only slightly vortical, is ignited and induces a zone of return currents. The zone of return currents, owing to asymmetry, starts oscillating adjacent to the geometrical axis of the pipe 4 at a frequency of 50 to 700 Hz thus causing acoustic oscillations at the same frequency.

At the same time a flow of hydrocarbons is fed to the auxiliary chamber 6 through the pipe 7 and moves radially to the pipe 8. Owing to a pressure difference the flow moves through the pipe 8 to the pipe 4. The admission of an auxiliary axial flow of hydrocarbons to the pipe 4 materially changes the radial gradient of density of the flow in the pipe 4 thus reducing its hydraulic resistance and lowering the pressure difference along the pipe 4 required for generating a vortex. Owing to the fact that the diameter of the pipe 8 is generally smaller than the diameter of the pipe 4 a lower pressure difference is required for providing a vortex.

With the ratio of diameters $d_2=\frac{1}{3}d_1$ there is an opportunity for the maximum interaction of axial and main rotary flows in the pipe 4. Further reduction of this ratio cannot provide for further reduction of radial density gradient in the pipe 4. An increase in the ratio materially changes the structure of flow in the pipe 4 and results in a greater hydraulic resistance to the flow and also in greater consumption of energy for creating the angular momentum.

At a certain combination of angular and linear velocities the aerodynamic apparatus generates resonance oscillations at a frequency f which is equal to a/4e, wherein e is the length of the pipe, a is sound velocity.

Both pipes 4 and 8 are of equal length. In a general case the length of each pipe 4 or 8 is at least two times the diameter of one of the pipes thus excluding external disturbances at the inlet section of the pipes 4 and 8.

In case a liquid hydrocarbon is used, it is fed through the pipe 17 (FIG. 3) into the pipe 4 at a pressure of 0.5 to 1 atmg. in the form of radial/jets provided by the perforated nozzle 18. The end of the pipe 17 is spaced at a distance of $(0.1-3)d_1$ from the end of the pipe 4. In case this distance is reduced the interaction of return flow and the flow of fuel mixture components diminishes thus resulting in a reduced turbulence of flows which is bound to contribute to a better dispersion of drops of liquid hydrocarbons in the flows and improve the degree of heat transmission from hot gases to the drops. An increase in the distance from the end of the pipe 17 to the end of the pipe 4 is not recommended for the following reasons. For stabilization of flow, the pipes 4,8 should be of a length of at least two times the diameter, but not to exceed five times the diameter. In case this value is greater than five, angular velocities of the flows of components decrease owing to increased friction. Since the angular velocity of flow is associated with power and frequency of acoustic oscillations, the power and frequency of the oscillations are reduced which can result in impaired efficiency of atomization. On the other hand, a strong submersion of the perforated nozzle 18 results in coking of drops of non-evaporated liquid hydrocarbons when they get to relatively cool walls of the outlet pipes 4 and 8.

Examples illustrating specific applications of the aerodynamic apparatus for mixing components of a fuel mixture are given below.

EXAMPLE 1

Air at 350° C. under pressure of 0.1 atmg, was fed along the pipeline 9 (FIG. 1) at a rate of 1200 kg/hr. Natural gas was fed to the chamber 1 of the aerodynamic apparatus at a rate of 35 $nm^3$/hr under pressure of 0.8 atmg. Natural gas was also fed to the auxiliary chamber 6 at a rate of 35 $nm^3$/hr under pressure of 0.6 atmg. As a result of interaction of vortical flows of air and gases, the combustion chamber 10 generated acoustic oscillations of 138 dB at a frequency of 10 kHz. The pipes 4 and 8 were equal in length. Compared to known apparatus, the output of the aerodynamic apparatus was increased by 1.5 times and energy consumption was 3 times lower.

EXAMPLE 2

Air at 350° C. under pressure of 0.1 atmg. was fed along the pipeline 9 (FIG. 3) at a rate of 1200 kg/hr. Air at 1.5 atmg. was also fed through the pipes 4 and 8 of the main and auxiliary chambers 1 and 6, and green oil under pressure of 0.8 kg/$cm^2$ was fed through the pipe 17. As a result of the interaction of vortical flows of air and gases, acoustic oscillations were generated by the combustion chamber at 146 dB and 10 kHz. Atomized oil with particle size up to 60 μm was fed to the combustion chamber 10 to be oxidized into soot. Compared to the prior art apparatus, the output of the aerodynamic apparatus was 1.5 times greater and the energy consumption was three times lower.

What is claimed is:

1. An aerodynamic apparatus for mixing components of a fuel mixture, comprising:

a first cylindrical chamber for swirling the flow of a gaseous component of said fuel mixture;

at least one pipe for admission of a gaseous component arranged in direct proximity to an end wall of said first cylindrical chamber tangentially to the cylindrical surface;

a first pipe for removal of a gaseous component of said fuel mixture arranged in the other end wall of said cylindrical chamber coaxially therewith;

a second cylindrical chamber for swirling the flow of a gaseous component of said fuel mixture arranged coaxially with said first cylindrical chamber;

at least one pipe of said second cylindrical chamber for admission of a gaseous component of said fuel mixture arranged in direct proximity to an end wall of the chamber tangentially to the cylindrical surface;

an opening in said end wall of said first cylindrical chamber coaxial therewith;

a second pipe for removal of a gaseous component of said fuel mixture arranged in said opening in such a manner that its end is within said first cylindrical chamber;

the ratio of diameters $d_1/d_2$ of said first and second pipes for removal of gaseous components of said fuel mixture ranging from 1 to 3; and a pipe having a perforated nozzle for admission of a liquid or solid component arranged in an opening of the end wall of said second cylindrical chamber, the end of the pipe being spaced at a distance of $(0.1-3)d_1$ from the end of said first pipe for removal of components.

2. An aerodynamic apparatus according to claim 1, wherein said first and second pipes for removal of components are of equal length.

* * * * *